US006017095A

United States Patent [19]

DiMillo

[11] Patent Number: 6,017,095

[45] Date of Patent: Jan. 25, 2000

[54] TUNNEL BORING MACHINE WITH CRUSHER

[76] Inventor: Tony DiMillo, 30 Stonegate St., R.R. #1, Gormely, Canada, L0H 1G0

[21] Appl. No.: 08/926,024

[22] Filed: Sep. 9, 1997

[51] Int. Cl.[7] ..... E21D 9/06

[52] U.S. Cl. ..... 299/56; 405/141

[58] Field of Search ..... 299/33, 55, 56, 299/68; 405/138, 141

[56] References Cited

U.S. PATENT DOCUMENTS

| | | | |
|---|---|---|---|
| 4,692,062 | 9/1987 | Toshio | 405/141 |
| 4,818,026 | 4/1989 | Toshihiro | 299/56 |

FOREIGN PATENT DOCUMENTS

| | | | |
|---|---|---|---|
| 0 352 349 | 1/1989 | European Pat. Off. . | |
| 0 410 353 | 1/1991 | European Pat. Off. . | |
| 4050559890 | 3/1993 | Japan | 405/141 |
| 2 254 092 | 9/1992 | United Kingdom . | |

OTHER PUBLICATIONS

Patent Abstracts of Japan vol. 014, No. 285 (M–0987), Jun. 20, 1990 JP 02 0888886 A (Mitsubishi Heavy Ind Ltd:Others:01), Mar. 29, 1990.

*Primary Examiner*—David Bagnell
*Assistant Examiner*—John Kreck

[57] ABSTRACT

The present invention relates to a tunnel boring machine particularly a micro-tunnelling machine having a cutting head rotatably mounted on the end of a housing and being driven by a first motor means and a rotatable central auger for removal of soil from the cutting operation mounted in the interior of the housing, the central auger being driven by a second motor means to allow rotation of the auger independent of the rotation of the cutting head. The tunnel boring machine may also be provided with a rock crusher between the cutting head and the auger to reduce boulders encountered during the tunneling to a size to be able to be transported by the auger.

4 Claims, 3 Drawing Sheets

TUNNEL BORING MACHINE WITH CRUSHER

FIELD OF THE INVENTION

The present invention relates to dry spoil tunnel boring machines and particularly to dry spoil tunnel boring machines having increased boring efficiency. The present invention also relates to dry spoil micro-tunnelling machines having increased efficiency.

BACKGROUND OF THE INVENTION

Various apparatus have been used for removing earth in a tunneling operation including the use of tunnel boring machines which are basically augers, to the use of digging machines such as back hoe type equipment. Tunnel boring machines commonly in use employ a rotating toothed cutting head at the end of a housing. As the cutting head rotates, the soil is loosened and passes into the housing where it is removed. At present there are two commonly employed techniques for removal of the debris from the tunneling operation, augers for dry spoil and slurries.

The auger systems use a central auger which rotates with the cutting head and moves the soil rearwardly and onto a conveyor for removal. Auger based tunneling machines often use a motor and gear train in the jacking pit to rotate the auger. Auger systems suffer drawbacks in some soil types. For example, loose or soft soil may increase in volume when exposed to air. Thus when drilling in loose soil, the soil may expand as it enters the cutting head and auger system and cause flooding of the housing. There have been machines developed which rely on the use of flood doors or gates to attempt to control the rate of soil transfer to maintain the pressure balance. Another problem is encountered in soil containing large rocks, where the rocks may be too large to enter the auger and may clog the removal of soil from the cutting head. While some rocks may be able to enter the auger system, there is still the possibility that they may become jammed in the auger system.

The other commonly employed method of removing soil involves the use of slurry systems. In this method the machine uses water to turn the excavated material into a pumpable fluid. The slurry normally requires a 15% solid mixture to achieve pumpable characteristics. Slurry-based machines have many drawbacks especially in colder climates where the slurry may be at risk of freezing during processing and disposal. In addition, silicifying materials such as clays take time and a lot of water to form into a slurry, whereas, sand courses absorb and disburse the water. In some types of soils the high pressure water may enlarge the diameter of the tunnel beyond the machine diameter and cause unexpected cave-ins. Since one must dispose of both a liquid and a solid waste, contaminated soils are an increasing environmental problem.

One particular group of tunnelling machines are those known as micro-tunnelling machines, which typically have diameters in the range of 2 meters or less, more particularly 1 to 1.5 meters in diameter. As these machines have very small diameters, they are generally remotely controlled from the jacking pit. These machines use a single motor and gear train in the jacking pit to rotate both the cutting head and auger simultaneously. Cutter head mining power loss on long drives is tremendous which is often the limiting factor in determining the length of the drive. Rotation of the cutting head with the auger also means that head rotation cannot be reversed as the auger will only move the spoil away from the face when rotated in one direction.

SUMMARY OF THE INVENTION

The present invention in one aspect relates to a micro-tunnelling machine having a cylindrical housing with a diameter of about 2 meters or less, the housing having a cutting head rotatably mounted on the end of a housing and being driven by a first motor means and a rotatable central auger for removal of soil from the cutting operation mounted in the interior of the housing. The central auger is driven by a second motor means to allow rotation of the auger independent of the rotation of the cutting head.

In another aspect of the invention there is provided a tunnel boring machine comprising a cylindrical housing having a cutting head rotatably mounted on the end of the housing and a rotatable central auger for removal of soil from the cutting operation mounted in the interior of the housing. A rock crusher is located between the cutting head and the auger to reduce boulders encountered during the tunneling to a size to be able to be transported by the auger.

BRIEF DESCRIPTION OF THE DRAWINGS

Preferred embodiments of the present invention are shown in the drawings wherein.

DETAILED DESCRIPTION OF THE PREFERRED EMBODIMENTS

Figure 1:
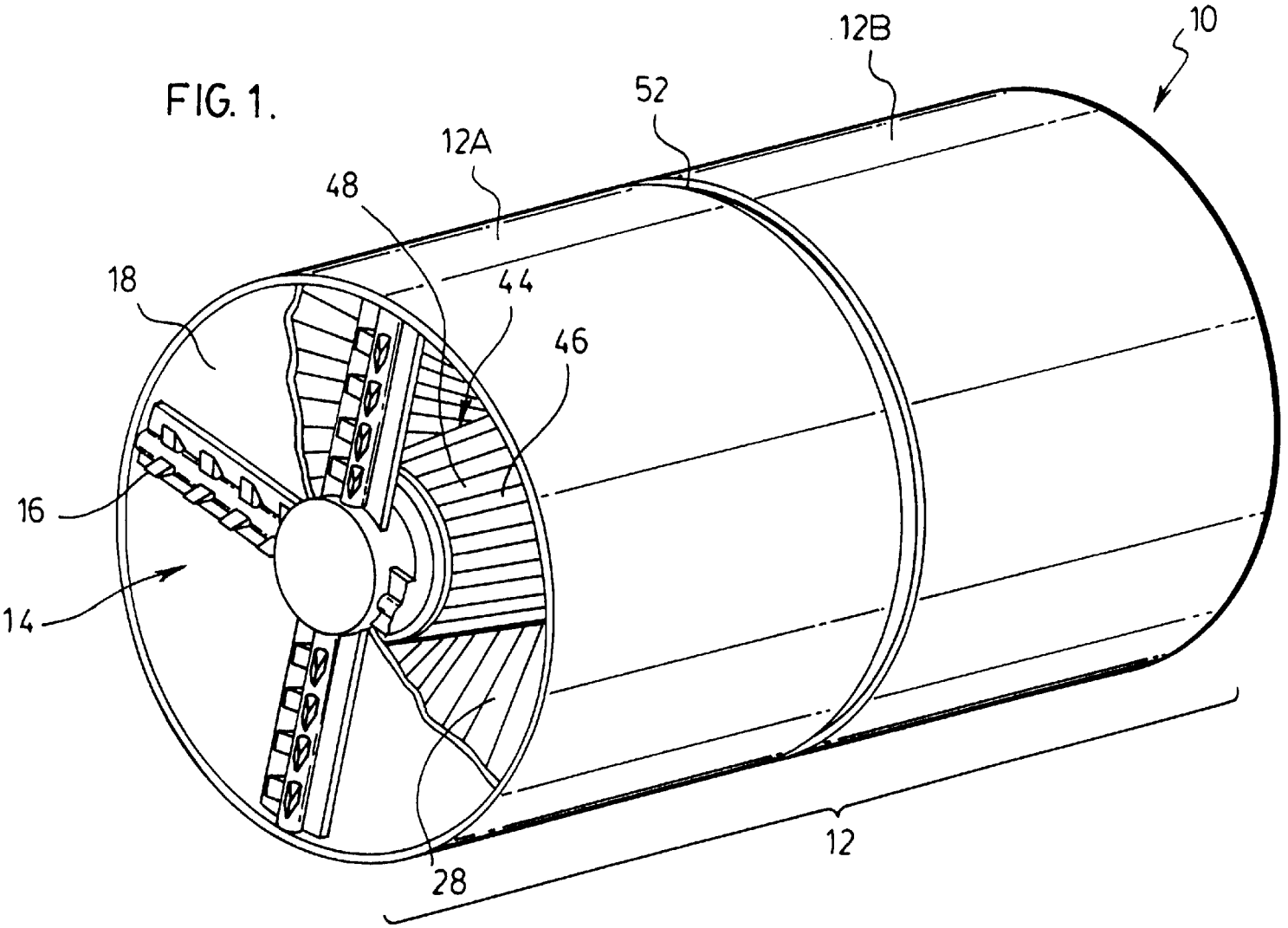
FIG. 1 is a perspective view partly in section of a preferred embodiment of a micro-tunnelling machine according to the present invention.
Figure 2:
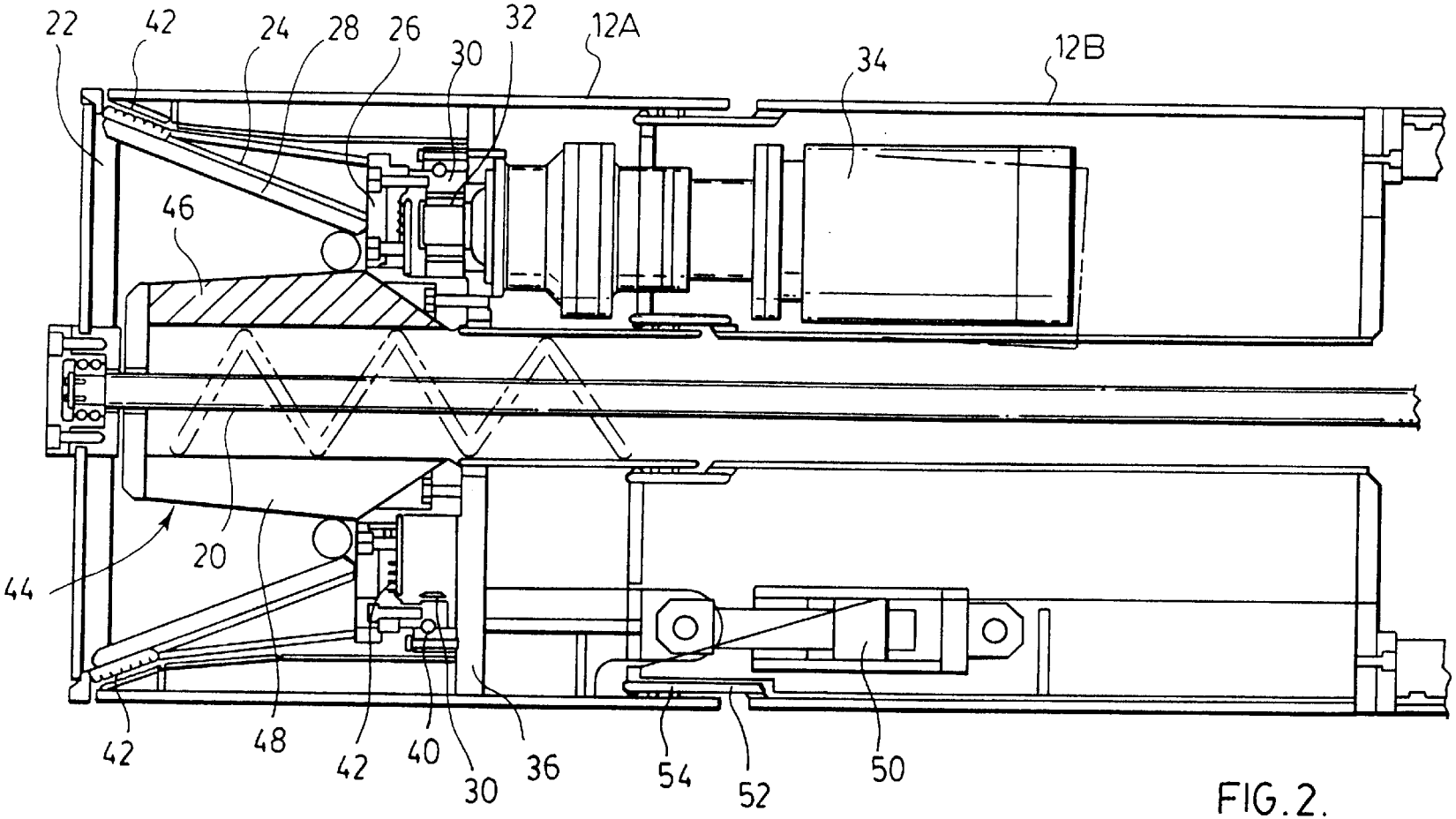
FIG. 2 is a side elevation view of the micro-tunnelling machine of FIG. 1.
Figure 3:
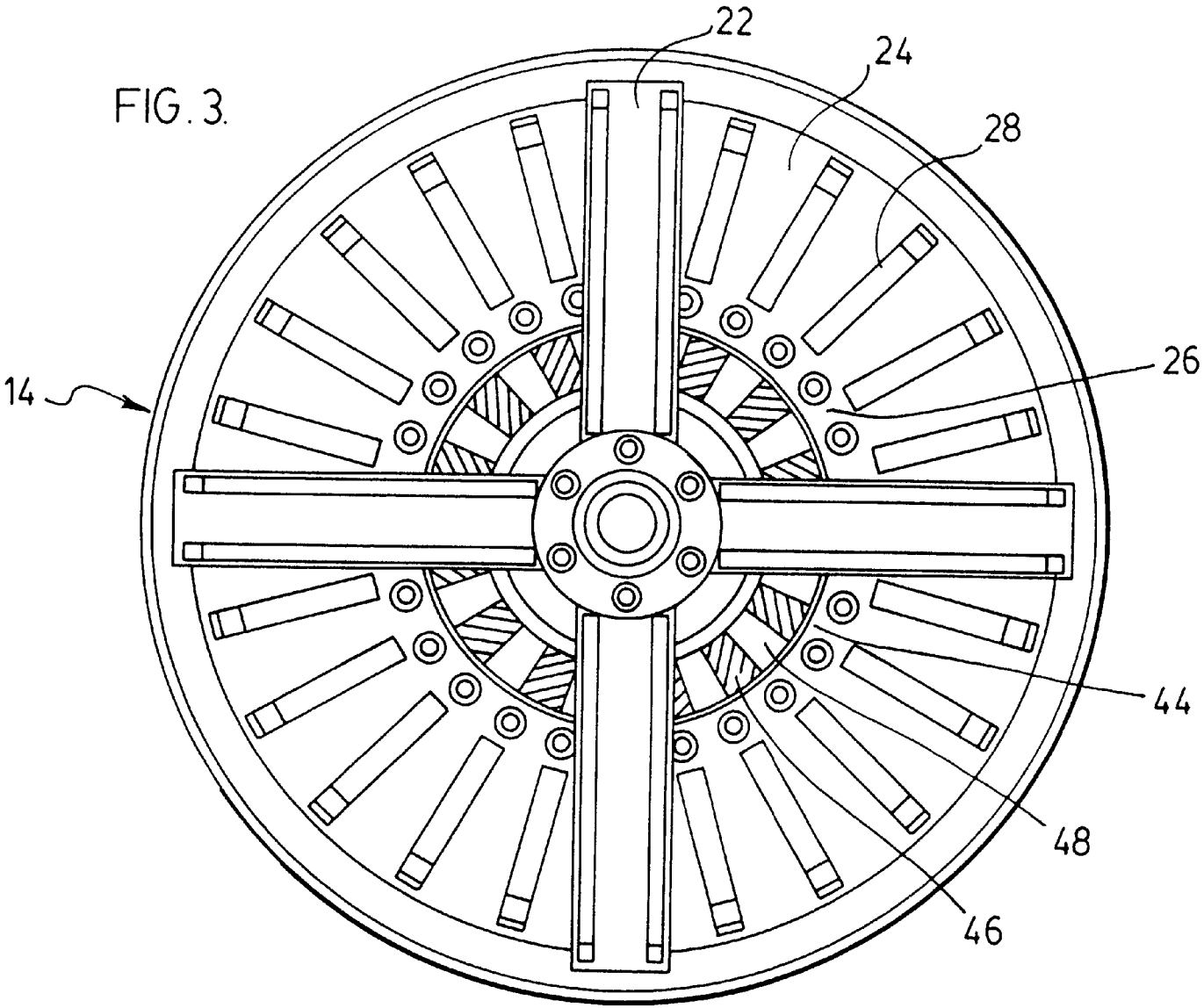
FIG. 3 is a front elevation view of the micro-tunnelling machine of FIG. 1.

A preferred embodiment of a micro-tunnelling machine according to the present invention is shown in the figures generally at 10. The machine 10 has a cylinder housing 12 sized based upon the desired size of the tunnel, typically in the range of 2 meters or less, more particularly 1 to 1.5 meters in diameter. At the end of the housing is located the cutting head 14 which generally includes cutting bars 16 and flood doors or gates 18 to aid in controlling the flow into the interior of the housing 12 of the material removed from the tunnel face. Once the material enters the housing 12 it is carried away by a central auger 20 to be disposed.

As shown in the figures, the cutting head 14 has a face plate 22 to which the cutting bars 16 and flood gates 18 are attached, inversely conical side walls 24 and a base plate 26. The cutting head 14 of the machine 10 illustrated in the figures is provided with four cutting bars 16 and flood gates 18. However, this number may vary depending upon the size of the machine 10 and the soil conditions in which the machine is used. In some circumstances cutting heads having three cutting bars and flood gates may be appropriate while in other circumstances more than four bars and gates may be appropriate. The side wall 24 of the cutting head 14 is provided with a series of radiating crusher bars 28 to form part of the rock crusher system. Attached to the base plate 26 of the cutting head 14 is a toothed ring gear 30 which engages a complementary gear 32 driven by a first motor 34 for rotation of the cutting head 14. The first motor 34 is attached to an annular base plate 36 attached along its periphery to the housing 12. A bearing ring 38 is also attached to the annular base plate 36 and cooperates with the ring gear 30 to form a cage 40 for ball bearings on which the cutting head rotates. A plurality of seals 42 are provided around the cutting head 14 for sealing the interior of the housing against passage of dirt and debris.

The central auger 20 is contained within an inner cone 44 which is fixed against rotation to the annular base plate 36. Inner cone 44 forms part of the rock crusher of the boring machine of the present invention. The wall of the inner cone 44 is constructed of a series of spaced apart crusher bars 46, the spacing 48 between the bars 46 regulating the size of rocks which will pass through and into the central auger system 20 as will be explained further below. The central auger 20 is rotated within the cone by means a second motor means in a generally conventional manner separate from the first motor means 34. In this way, the rotation of the central auger 20 can be controlled independent of the rotation of the cutting head 14.

The micro-tunnelling machine 10 of the present invention is preferably capable of articulated steering simultaneously in both the vertical and horizontal directions. The steering is accomplished by providing the housing 12 in two parts 12A and 12B, which are connected together through the use of articulation cylinders 50. Preferably the machine 10 is provided with three or four of these articulation cylinders 50 spaced along the interior circumference of the housing 12. One end of the articulation cylinder 50 is attached to one part of the housing 12A and a second end of the articulation cylinder 50 is attached to the second part of the housing 12B. A ring 52 of reduced diameter is attached to housing 12B and extends into the interior of housing 12A. Seals 54 are located between the ring 52 and the interior of housing 12A to seal against ingress of material into the interior of the housing 12.

In operation, the first motor means 34 drives the cutting head 14 at a suitable speed through the use of the motor gear 32 and ring gear 30 to effect removal of material from the face of the tunnel. Simultaneously the second motor means is utilized to drive the central auger 20 to remove the material entering the interior of the cutting head 14. Soils and small rocks or pebbles pass directly through the spacing 48 between the crusher bars 46 of the inner cone 44 and into the central auger system 20 to be removed. Rocks and boulders which are larger than the size of the spacing are crushed by the rotating crusher bars 28 on the cutting head 14 and the stationary crusher bars 46 on the inner cone 44. This movement of the rock or boulder between the two bars reduces the rock to a size which allows it to pass through the spacing 48 and be removed by the central auger system. Propulsion of the tunnel boring machine 10 is carried out in a conventional manner by pipe-jacking technology.

By controlling actuation of the articulation cylinder 50, the cutter head 14 is capable of articulated steering of up to about two to three degrees in both the vertical and horizontal directions.

An important factor in the efficiency of tunneling operations is the maintenance of earth pressure balances. Maintaining earth pressure balance is directly related to the cutting head, propulsion and conveyor subsystem design and operations. As the soil pressure varies over the length of the drive, pressure sensors, in the cutter head near the face, will monitor the pressure. The thrust force of the propulsion system, auger rate of rotation and cutting head rate of rotation can be varied independently based on the soil conditions encountered. By adjusting the rate of auger rotation, cutting head rotation and jacking force, pressure reduction of the waste may take place inside the auger conveyor.

The micro-tunnelling machine of the present invention has two independent drive trains, one controlling the rate of cutter head rotation and the second controlling the rate of spoil auger rotation. In this way the earth pressure balance can be maintained without the use of slurry. The auger can be rotated at a higher rate of rotation than the cutting head to permit the spoil to expand inside the auger while maintaining a balanced pressure at the face of the tunnel.

By driving the cutting head independent of the auger conveyor, the cutting head is also permitted to rotate in both directions while maintaining the rotation of the auger to remove spoil. This can be an advantage when trying to maintain roll attitude and for navigation around certain obstacles. It also provides for an additional operational mode when encountering non-standard conditions particularly difficult boulders that require crushing.

The present invention also provides an auger type tunnel boring machine having a rock crusher to reduce the size of rocks encountered in the tunneling operation to a size which can be easily managed by the central auger. While the crusher bars 28 and 46 which form the rock crusher are shown in the figures as straight radiating bars, other structures are possible. For example, the bars 28 or 46 could be provided as curved radiating bars or they could be concentric circles provided along the depth of the side wall 24 or inner cone 44. The rock crusher of the present invention in addition to being used with micro-tunnelling machines, may also be used with tunnel boring machines of any size including those larger than the micro-tunnelling machines. The use of the rock crusher enables the tunnel boring machine to operate in diverse soil types with reduced possibility of the machines auger system being clogged with large spoil.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are as follows:

1. A micro-tunnelling machine comprising a cylindrical housing having a diameter of about 2 meters or less, the housing having a cutting head rotatably mounted on the end of the housing and being driven by a first motor means; a rotatable central auger for removal of soil from the cutting operation mounted in the interior of the housing, the central auger being driven by a second motor means to allow rotation of the auger independent of the rotation of the cutting head; a rock crusher between the cutting head and the auger to reduce boulders encountered during the tunneling to a size to be able to be transported by the auger; and a cone surrounding the intake end of the central auger, the cone being provided with spaced apart bars to limit the size of debris capable of entering the central auger.

2. A micro-tunnelling machine as claimed in claim 1 wherein the cutting head has crusher bars mounted on an interior surface which cooperate with the spaced apart bars of the cone to provide a rock crusher to reduce large rocks to a size capable of entering the central auger.

3. A tunnel boring machine comprising a cylindrical housing having a cutting head rotatably mounted on the end of the housing, a rotatable central auger for removal of soil from the cutting operation mounted in the interior of the housing, a rock crusher being located between the cutting head and the auger to reduce boulders encountered during the tunneling to a size to be able to be transported by the auger and a cone surrounding the intake end of the central auger, the cone being provided with spaced apart bars forming part of the rock crusher to limit the size of debris capable of entering the central auger.

4. A tunnel boring machine as claimed in claim 3 wherein the cutting head has crusher bars mounted on an interior surface which cooperate with the spaced apart bars of the cone to provide the rock crusher to reduce large rocks to a size capable of entering the central auger.

* * * * *